United States Patent [19]

Sanders, Jr. et al.

[11] Patent Number: 4,969,758

[45] Date of Patent: Nov. 13, 1990

[54] METHOD OF IMPROVING THE PRINTING SPEED OF AN IMPACT DOT PRINTER PRINTING IN A NEAR LETTER QUALITY MODE

[75] Inventors: Royden C. Sanders, Jr., Burton Hwy., Wilton, N.H. 03086; John A. Sanders, Nashua, N.H.

[73] Assignee: Royden C. Sanders, Jr., Wilton, N.H.

[21] Appl. No.: 324,229

[22] Filed: Mar. 15, 1989

Related U.S. Application Data

[63] Continuation-in-part of Ser. No. 172,708, Mar. 24, 1988, abandoned.

[51] Int. Cl.[5] ..... B41J 2/51

[52] U.S. Cl. ..... 400/124; 400/121

[58] Field of Search ..... 400/121, 124; 101/93.04, 93.05; 346/108

[56] References Cited

U.S. PATENT DOCUMENTS 4,653,941 3/1987 Suzuki ..... 400/121

*Primary Examiner*—David A. Wiecking

*Attorney, Agent, or Firm*—Davis, Bujold and Streck

[57] ABSTRACT

A method of operating an impact printer having a printhead normally intended to create letter quality characters during one pass across the printing medium at a carriage speed at least three times slower than the carriage speed at which the printer creates draft quality characters wherein the method of operation produces letter quality characters at least 50% faster than the prior art method of operation. To accomplish the throughput increase, the printer is operated in the same faster draft speed for the printing of both draft and letter quality characters. Letter quality characters, however, are created in two passes and the printing medium is not advanced to a next row position until after the two passes. During the first pass, the carriage is moved across the printing medium while printing one of each pair of horizontally close adjacent dots includes in the vertical strokes of the characters comprising a row of characters and a portion of other dots included in the row of characters. During the second pass, the other of each pair of horizontally close adjacent dots included in the vertical strokes of the characters comprising the said row of characters and any remaining unprinted other dots are printed.

3 Claims, 3 Drawing Sheets

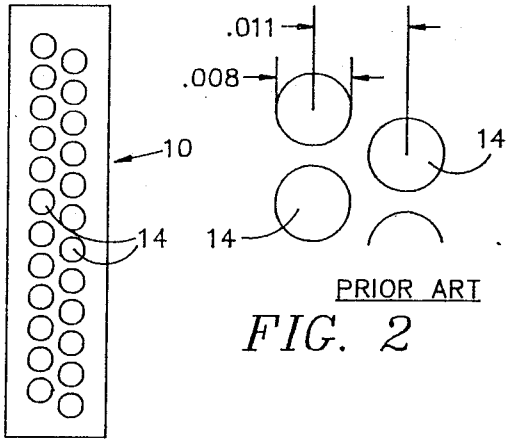
PRIOR ART
FIG. 1
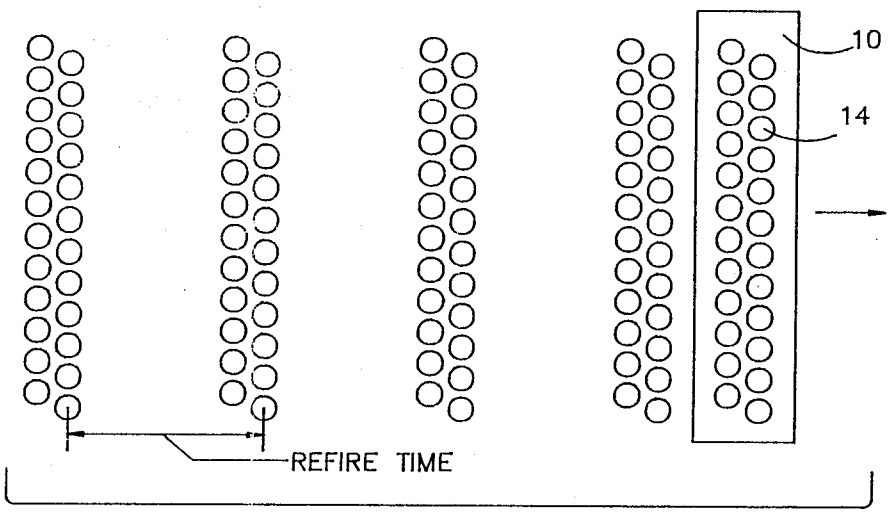
PRIOR ART
FIG. 2
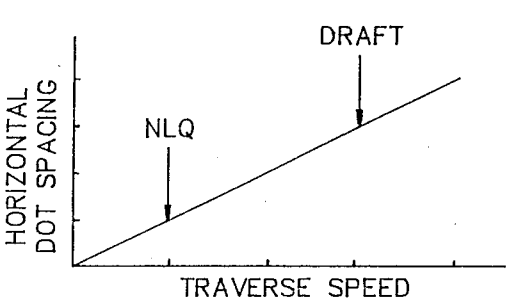
PRIOR ART
FIG. 4
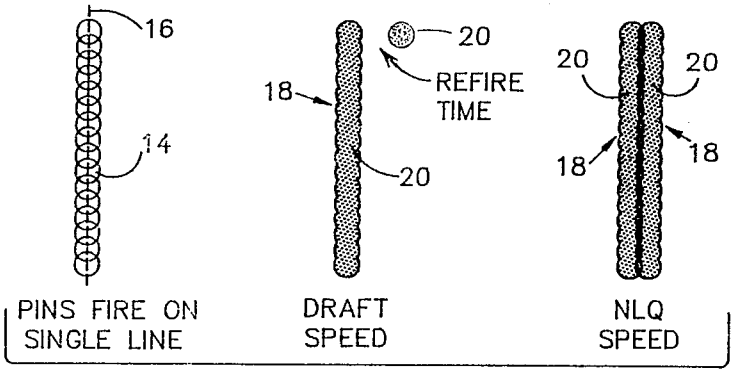
PRIOR ART
FIG. 3
PRIOR ART
FIG. 5

METHOD OF IMPROVING THE PRINTING SPEED OF AN IMPACT DOT PRINTER PRINTING IN A NEAR LETTER QUALITY MODE

This application is a continuation-in-part of application Ser. No. 172,708, filed 24 Mar. 1988, now abandoned.

BACKGROUND OF THE INVENTION

This invention relates to impact dot printers employed for printing alphanumeric characters on a printing medium and, more particularly, to printing logic for use in an impact printer having a carriage moveable across a printing medium in passes from side to side, motor drive means for selectably moving the carriage, a printhead including a plurality of vertically oriented printwires disposed for printing a row of draft quality characters in one pass at a first carriage speed or a row of letter quality characters including vertical strokes of a width requiring pairs of horizontally close adjacent dots in one pass at a second carriage speed which is about three times slower than the first carriage speed, printing medium advancing means for advancing the printing medium from one printing row position to a next printing row position, and printing logic connected to the motor drive means, for moving the carriage across the printing medium, the printhead, and the printing medium advancing means for causing the printhead to print dots on the printing medium with the printwires, and for advancing the printing medium from one printing row position to a next printing row position, the logic of the invention being adapted for increasing the throughput of the printer when printing letter quality characters and comprising logic for performing the steps of:

(a) deciding if the printer is to print draft quality or letter quality characters and if it is to print draft quality characters going to step (b), otherwise continuing to step (e);

(b) moving the carriage across the printing medium at the faster first carriage speed while printing all the dots of the characters comprising a row of characters;

(c) advancing the printing medium to a position for the printing of a next row of characters; and, (d) if the printer is finished printing an indicated number of rows of characters to be printed, then exiting, otherwise returning to step (b);

(e) moving the carriage across the printing medium in a first pass at the faster first carriage speed while printing one of each pair of horizontally close adjacent dots included in the vertical strokes of the characters comprising a row of characters and a portion of other dots included in the row of characters;

(f) moving the carriage across the printing medium in a second pass at the same faster first carriage speed while printing the other of each pair of horizontally close adjacent dots included in the vertical strokes of the characters comprising the row of characters and any remaining unprinted other dots included in the row of characters;

(g) advancing the printing medium to a position for the printing of a next row of characters only after the first and second passes; and, (h) if the printer is finished printing an indicated number of rows of characters to be printed, then exiting, otherwise returning to step (e).

As described in the parent application of which this is a continuation-in-part, U.S. Pat. No. 4,159,882 by Sanders et al. describes the first proposed multipass printing which, in some form, most of today's 9-pin printhead impact dot printers utilize. That patent teaches that by making two, three, or four passes with the printhead and with appropriate vertical motion between the printhead and the paper being printed on of, respectively, ½ pin spacing, ⅓ pin spacing or ¼ pin spacing between passes, increased vertical resolution in the printed character could be obtained. This allowed the first Near Letter Quality (NLQ) and Letter Quality (LQ) characters to be printed by impact dot matrix printers. In such a system, there is no serious problem relative to increasing the horizontal resolution. As is readily known and appreciated by those skilled in the art, horizontal resolution (and character quality, including such features as bold typeface) can be created by simply doing more passes and/or partial vertical paper movement with a printhead having a relatively small number of pins.

As with most things involving computing, mechanical dot printing (involving for, example, impact, electrostatic, ink jet, etc. printheads) is a tradeoff between cost of materials (i.e. apparatus), print quality, and speed of throughput. In general, the impact type printhead have design limiting considerations with respect to speed of dot creation; that is, of the above-listed examples of dot creating printers, only the impact printer create their dots with a mechanical driving mechanism. In such printers, each dot is created by one end of a fine printwire being struck or pushed by a solenoid type actuator. The other end of the printwire is then pushed out of a printhead and strikes the printing medium through an inked ribbon which causes the ribbon at that point to create a dot on the printing medium. The limiting factor is the so-called "refire" rate, i.e. the time it takes for the mechanical printwire/actuator combination to strike one dot and then recycle to "fire" and create the next dot.

In an effort to improve the speed and quality of impact type printers, single pass printheads were introduced. Such a prior art printhead is depicted in simplified form in FIG. 1 where it is generally indicated as 10. The printhead 10 has a body containing two staggered rows of printwires 14. Other types of printwire arrangements are available; however, the principle of operation is the same as in the representative example of FIG. 1. The printheads are referred to by the number of printwires 14 (or "pins") they contain. Most often, such printheads contain eighteen or twenty-four pins. The 18-pin printheads are typically made with 11, 12 and 14 mil pins (i.e., printwires 14). The majority of 24-pin printheads are made with 8 mil pins as this type of printer was originally developed for Asian characters such as Kanji or Hanguel. These characters need the fine 10 mil strokes made by 8 mil pins because of their much greater character complexity. The 8 mil pins create a 10 mil dot on the print medium because of the intervening ribbon through which the printwire contacts the print medium, as described above.

When the above-described printheads are incorporated into printers intended for printing non-Asian characters as employed in the Western world, the stroke width must be increased. This, in turn, leads to serious print speed problems. Currently, 24-pin printers, such as the Toshiba model 321SL, print Letter Quality with one pass of the printhead at 6 inches per second (IPS) carriage speed, i.e. the transit speed at which the printhead 10 is moved laterally across the printing medium. The printer can print very good quality characters at 10 characters per inch (CPI), producing 60 characters per second (CPS). The dots are printed at 180 dots per inch (DPI) at this speed, although the horizontal resolution is 1/360". These printers are able to generate vertical strokes of 10, 15.5 or 21 mils width. The same quality letters could be printed at 120 DPI, which would increase the speed 50%, except that it would make the vertical strokes 10, 18.3 or 26.6 mils, i.e. either too thin or too thick for non-Asian characters.

The problem is depicted in FIGS. 3–5. As the printhead moves across the printing medium from, for example left to right as depicted in FIG. 3, the printwires 14 can only be fired after the refire time has elapsed since the last firing thereof. As depicted in FIG. 2, the vertical rows of 8 mil printwires 14 must be spaced from one another by integer multiples of the horizonal resolution. Thus, for example, the vertical rows of printwires 14 may be on 4/360" centers as depicted in the figure. This aspect is not critical to the problem being described, however. It is the refire time vis-a-vis the carriage speed that causes the problem. As depicted in the left portion of FIG. 5, the adjacent vertical rows of printwires 14 may be fired at slightly different times (depending on the horizontal spacing between the vertical rows) so as to fire along a common vertical line 16 and thereby create a vertical row 18 of over lapped dots 20 as depicted in the center portion of FIG. 5. As graphed in FIG. 4, given a fixed refire rate, the faster the printhead 10 traverses the printing medium, the greater the distance between the adjacent vertical lines 16 along which the dots 20 can be created. At a typical "draft speed", the dots 20 are spaced apart 1/16" between centers and 6.6 mils between dot edges as depicted in the center portion of FIG. 5. To get the LQ or NLQ character definition in one pass, the carriage speed must be drastically reduced to 1/3rd the draft speed giving a spacing between centers of 1/180" with a dot overlap of 2 mils as indicated in the graph of FIG. 4. This speed reduction is typically a factor of three, or even four; that is, in the NLQ or LQ mode, the printer operates at one-fourth to one-third the carriage speed that it employs in the draft mode.

Wherefore, it is the object of the present invention to provide a novel method of operating a 24-pin printhead, or the like, which will provide a substantial increase in the print speed of such printheads when printing in the NLQ or LQ mode.

Other objects and benefits of this invention will become apparent from the description which follows hereinafter when taken in conjunction with the drawing figures which accompany it.

SUMMARY

The foregoing object has been achieved in an impact printer having a carriage movable across a printing medium in passes from side to side, motor drive means for selectably moving the carriage, a printhead including a plurality of vertically oriented printwires disposed for printing a row of draft quality characters in one pass at a first carriage speed or a row of letter quality characters including vertical strokes of a width requiring pairs of horizontally close adjacent dots in one pass at a second carriage speed which is around three times slower than the first carriage speed, printing medium advancing means for advancing the printing medium from one printing row position to the next printing row position, and printing logic connected to the motor drive means, for moving the carriage across the printing medium, the printhead, and the printing medium advancing means for causing the printhead to print dots on the printing medium with the printwires, and for advancing the printing medium from one printing row position to a next printing row position. This describes physically what exists in just about all 24 pin printers. The improved method of operation of the present invention for increasing the throughput of the printer when printing letter quality characters comprises the steps of:

(a) moving the carriage across the printing medium in a first pass at the faster first carriage speed while printing one of each pair of horizontally close adjacent dots included in the vertical strokes of the characters comprising a row of characters and a portion of other dots included in the row of characters;

(b) moving the carriage across the printing medium in a second pass at the same faster first carriage speed while printing the other of each pair of horizontally close adjacent dots included in the vertical strokes of the characters comprising the row of characters and any remaining unprinted other dots included in the row of characters; and, (c) advancing the printing medium to a position for the printing of a next, row of characters only after the first and second passes.

DESCRIPTION OF THE DRAWINGS

FIG. 1 is a simplified drawing of a typical prior art 24-pin printhead as wherein the novel method of operation of the present invention is applicable to improve the printing speed thereof.

FIG. 2 is a simplified enlarged drawing of pins in adjacent rows of the printhead of FIG. 1 showing typical pin size and spacing.

FIG. 3 is a drawing depicting the problem which leads to slower printing speeds when the printhead of FIG. 1 is employed to print near letter quality characters employing the generally accepted prior art method of operation thereof as employed by the printer manufacturers and incorporated into their printing equipment.

FIG. 4 is a graph depicting the effect of printhead traverse speed on dot spacing where the refire time of the printhead remains constant.

FIG. 5 is another drawing depicting the problem which leads to slower printing speeds when the printhead of FIG. 1 is employed to print near letter quality characters employing the generally accepted prior art method of operation thereof as taught by the printer manufacturers and incorporated into their printing equipment.

DESCRIPTION OF THE PREFERRED EMBODIMENT

The object of the invention is attained by operating, for example, a 24-pin printhead in a manner exactly opposite its intended manner of operation as instructed by the manufacturers thereof. By so doing, the inventor herein was able to surprisingly and unexpectedly attain a 50% (or even greater) increase in the printing speed of NLQ and LQ characters by such a printhead.

Figure 6:
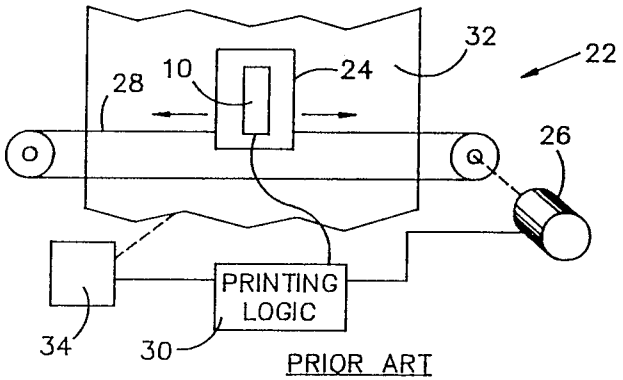
PRIOR ART FIG. 6
FIG. 6 is a simplified drawing of an impact printer as wherein the present invention is applicable.

Consider the typical prior art impact printer 22 of FIG. 6 including carriage 24 having a printhead 10 such as the printhead of FIG. 1 with a row 18 of vertically oriented printwires 14 capable of printing dots of diameter "d" and having driving assembly for moving the carriage 24 back and forth across the printing medium 32 including a drive motor 26 connected to the carriage 24 through a drive belt 28 and a printing medium advance mechanism 34 wherein the drive motor 26, printhead 10, and printing medium advance mechanism 34 are connected to printing logic 30 to be controlled thereby. The typical prior art impact printer 22 is driven by the logic 30 in two modes—draft mode and LQ (or NLQ) mode. If the refire rate is "r" milliseconds and it is desired to create vertical strokes having a width of 2d in LQ characters, the carriage speed "lqs" in the LQ mode must be such that r.lqs=d; that is, the printhead 10 will only move from the vertical position of one row of dots it has created to a position one dot width, i.e. "d", away when it can next refire to create the adjacent row of dots for a total dot width of 2d. Since the quality of draft mode characters is less important and speed is the prime factor of importance, the carriage speed in the draft mode may be several times the LQ speed, e.g., the draft quality speed "dqs" could equal 31 qs.

Figure 7:
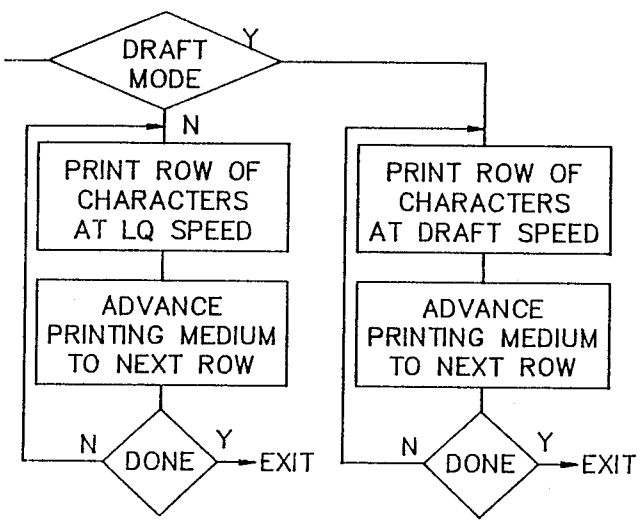
PRIOR ART FIG. 7
FIG. 7 is a flowchart of the logic implemented by the printer of FIG. 6 when printing according to the prior art method.

From the introduction of such printer, the above-described process has been the accepted mode of operation; that is, the manufacturers state that such printers have two speeds, draft speed and LQ speed, and one is stuck with a LQ speed which will create the desired vertical stroke width at the refire rate of the printhead incorporated into the printer. This well accepted prior art printing method is shown in the flowchart of FIG. 7. Note that once the decision is made as to whether the printer 22 is in the draft or LQ mode, the logic is basically the same, each row of characters is printed in one pass at the proper carriage speed to affect the desired vertical stroke width. In this regard, it is important to note that the prior art method of driving a printer 10 treats aspects such as *underlining*, bold typeface, and the like, as a second row of characters on the same line; that is, the printing medium 32 is not advanced and the row of special characters needed to create the desired effect on the previously printed row is printed without moving the printing medium 32 vertically. The present invention is based on violating the above-described prime directive of the printer manufacturers by employing the novel driving method shown in the flowchart of FIG. 8. As can be seen, in the method of this invention, only the draft quality carriage speed is employed for both the draft and letter quality modes of operation. Thus, not only is there a substantial increase in printing throughput in the LQ mode; but, additionally, a cheaper, single speed drive motor 26 can be employed with an attendant savings in cost of manufacture as well.

Figure 8:
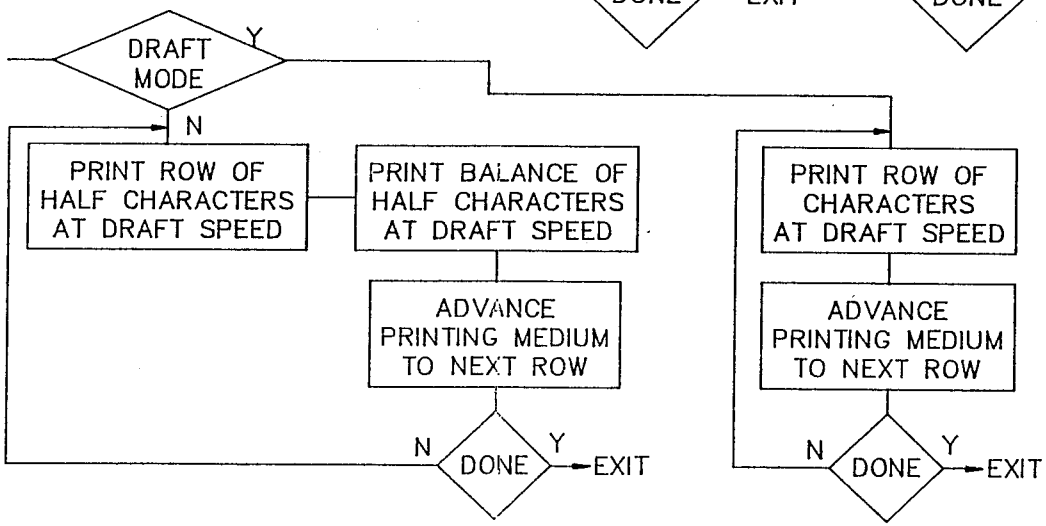
FIG. 8 is a flowchart of the logic implemented by the printer of FIG. 6 when printing according to the method of the present invention.
Figure 9E:
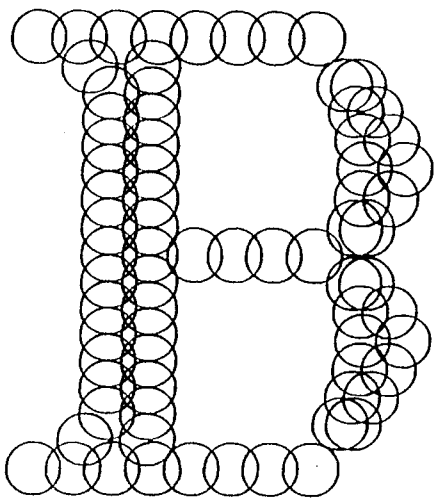
FIGS. 9*a* through 9*f* illustrate a Times Roman Capital B printed according to the present invention.
Figure 9F:
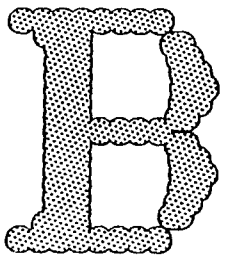
Figure 9C:
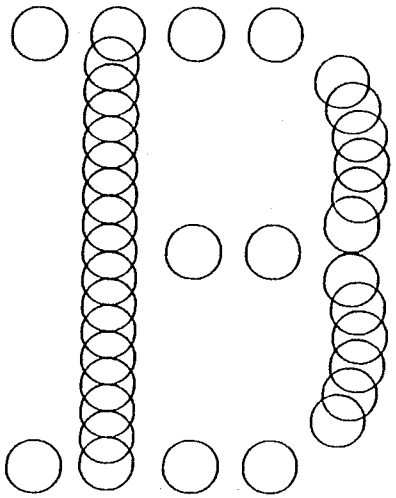
Figure 9D:
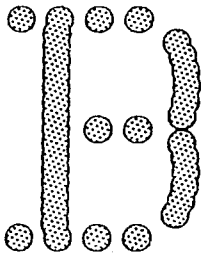
Figure 9A:
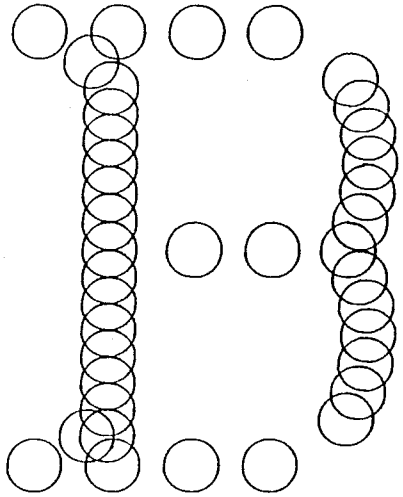
Figure 9B:
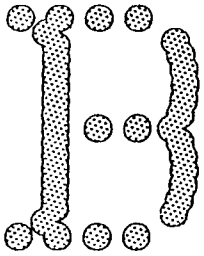

To implement the novel method of the present invention, the logic of FIG. 8 is employed in the printing logic 30 driving the drive motor 26, the printhead 10, and the printing medium advancing means 34 of a printer 22 such as that of FIG. 6. If desired, a pre-existing printer can be retrofitted to practice the present invention and derive the benefits thereof by retaining the mechanical components and merely changing the logic within the printing logic 30. As can be seen from FIG. 8, the logic makes the same first decision as in the prior art flowchart of FIG. 7; that is, the logic first determines if it is in the draft or LQ mode. If it is in the draft mode, it prints the rows of characters at draft speed just as in the logic of FIG. 7. If, however, it is in the LQ mode, a major deviation from the prior art approach of FIG. 7 takes place. Referring to FIG. 9, operating at draft speed (instead of the substantially slower LQ speed of the prior art method), the printing logic 30 causes the printhead 10 to print a row of half characters (where the term "half character" refers to the vertical strokes of a line of characters and every other dot in the horizontal lines 9*a* and 9*b*). In other words, the logic 30 prints half the dots in all the vertical strokes in the row on a first transition of the carriage 24 across the printing medium 32 as shown in FIG. 9*a* and 9*b*. The dots comprising the other aspects of the row of characters can be done at this time or during the second pass to follow, as desired. In a second pass across the printing medium 32 (again at the faster draft speed), the logic 30 causes the printhead 10 to produce the balance of the half characters (i.e. the second row of adjacent dots 20 to create the desired width of vertical strokes) as well as any remaining portions of the characters of the row not printed on the first pass as shown in FIG. 9*b* and 9*c*. The resultant character is shown in FIG. 9*e* and 9*f*. Then, and only then, does the logic 30 cause the printing medium 32 to advance to the next row to be printed. As in the prior art of FIG. 7 and as described above, if character enhancements are required to the now printed row of characters (such as bold or *underlining*) this is accomplished by printing another row of "characters" on the same vertical position employing a third (or even fourth) pass as necessary to create the desired effect.

At the printing speed of contemporary impact printers, the facts upon which this invention is based are not readily obvious or apparent. All that one watching the operation of such a printer is aware of is that there is a difference between the draft and letter quality speeds and that the carriage of the printer is moving quite rapidly. Typically, such printers work bidirectionally; that is, they print in both directions and there is no dead time during "carriage return" as in most typewriters and single direction printers. The above-described novel method of operation only became apparent to the inventor herein when he was taking detailed timing measurements related to the operation of impact printers with electronic instrumentation for other purposes and he suddenly recognized and realized that with the improved turnaround times being achieved (i.e. the time for the carriage 24 to reverse direction), the time for the printhead 10 to make two printing passes over the printing medium 32 at draft speed was still less than the time for the printhead 10 to make one pass at LQ speed. Quite surprisingly (and completely unexpectedly as confirmed by subsequent conversations on the subject with printer manufacturers) while the single pass at LQ speed took time "3t", for example, each of the two passes at three times the speed took time t, or a total of 2t for the two passes. Thus, the inventor herein realized that the printing of the characters in LQ mode could be affected at draft speed in two-thirds the elapsed time of the prior art method—a 50% increase in speed—by printing them in two passes instead of the tradition one pass that those skilled in the art assumed was the fastest approach. Obviously, where the difference between the LQ and draft speed is greater, the time savings (and, therefore, attendant percentage improvement in printer performance) is also greater.

Thus, it can be seen from the foregoing description that by deviating from standard and accepted practice and adopting the novel two pass method of operation of the present invention, a substantial increase in printer performance in impact printers employing printheads designed for single pass use can be realized.

Wherefore, having thus described my invention, what is claimed is:

1. A method of printing letter quality dot matrix characters comprising the steps of:

(a) providing an impact printer having (1) a carriage moveable across a printing medium in passes from side to side, (2) motor drive means for selectably moving the carriage at a faster, first, speed and a slower, second, speed, (3) a printhead including a plurality of vertically oriented printwires and designed to print a row of draft quality characters in one pass at said first carriage speed or a row of letter quality characters including vertical strokes of a width requiring pairs of horizontally close adjacent dots in one pass at said second carriage speed, (4) printing medium advancing means for advancing the printing medium from one printing row position to a next printing row position, and (5) means for controlling the speed and direction of movement of the carriage across the printing medium, for controlling the printhead to cause it to print dots on the printing medium with the printwires, and for controlling the printing medium advancing means to cause it to advance the printing medium from one printing row position to a next printing row position;

(b) moving the carriage across the printing medium in a first pass at the faster, first, carriage speed while printing one of each pair of horizontally close adjacent dots included in the vertical strokes of the characters comprising a row of characters and a portion of other dots included in said row of characters;

(c) moving the carriage across the printing medium in a second pass at the same faster, first, carriage speed while printing the other of each pair of horizontally close adjacent dots included in said vertical strokes of said characters comprising said row of characters and any remaining unprinted other dots included in said row of characters; and, (d) advancing the printing medium to a position for the printing of a next row of characters only after said first and second passes.

2. A method of printing letter quality dot matrix characters comprising the steps of:

(a) providing an impact printer having (1) a carriage moveable across a printing medium in passes from side to side, (2) motor drive means for selectably moving the carriage at a faster, first, speed and a slower, second, speed, (3) a printhead including a plurality of vertically oriented printwires and designed to print a row of draft quality characters in one pass at said first carriage speed or a row of letter quality characters including vertical strokes of a width requiring pairs of horizontally close adjacent dots in one pass at said second carriage speed, (4) printing medium advancing means for advancing the printing medium from one printing row position to a next printing row position, and (5) means for controlling the speed and direction of movement of the carriage across the printing medium, for controlling the printhead to cause it to print dots on the printing medium with the printwires, and for controlling the printing medium advancing means to cause it to advance the printing medium from one printing row position to a next printing row position;

(b) deciding if the printer is to print draft quality or letter quality characters and if it is to print letter quality characters going to step (f), otherwise continuing to step (c);

(c) moving the carriage across the printing medium at the faster, first, carriage speed while printing all the dots of the characters comprising a row of characters;

(d) advancing the printing medium to a position for the printing of a next row of characters; and, (e) if the printer is finished printing an indicated number of rows of characters to be printed, then exiting, otherwise returning to step (c);

(f) moving the carriage across the printing medium in a first pass at the faster, first, carriage speed while printing one of each pair of horizontally close adjacent dots included in the vertical strokes of the characters comprising a row of characters and a portion of other dots included in said row of characters;

(g) moving the carriage across the printing medium in a second pass at the same faster, first, carriage speed while printing the other of each pair of horizontally close adjacent dots included in said vertical strokes of said characters comprising said row of characters and any remaining unprinted other dots included in said row of characters;

(h) advancing the printing medium to a position for the printing of a next row of characters only after said first and second passes; and, (i) if the printer is finished printing an indicated number of rows of characters to be printed, then exiting, otherwise returning to step (f).

3. Printing logic for producing letter quality dot matrix characters in an impact printer having:

(1) a carriage moveable across a printing medium in passes from side to side, (2) motor drive means for selectably moving the carriage at a faster, first, speed and a slower, second, speed, (3) a printhead including a plurality of vertically oriented printwires and designed to print a row of draft quality characters in one pass at said first carriage speed or a row of letter quality characters including vertical strokes of a width requiring pairs of horizontally close adjacent dots in one pass at said second carriage speed, and (4) printing medium advancing means for advancing the printing medium from one printing row position to a next printing row position, wherein (5) the printing logic controls the speed and direction of movement of the carriage across the printing medium, the printhead to cause it to print dots on the printing medium with the printwires, and the printing medium advancing means to cause it to advance the printing medium from one printing row position to a next printing row position; comprising the steps of:

(a) deciding if the printer is to print draft quality or letter quality characters and if it is to print letter quality characters going to step (e), otherwise continuing to step (b);

(b) moving the carriage across the printing medium at the faster, first, carriage speed while printing all the dots of the characters comprising a row of characters;

(c) advancing the printing medium to a position for the printing of a next row of characters; and, (d) if the printer is finished printing an indicated number of rows of characters to be printed, then exiting, otherwise returning to step (b);

(e) moving the carriage across the printing medium in a first pass at the faster, first, carriage speed while printing one of each pair of horizontally close adjacent dots included in the vertical strokes of the characters comprising a row of characters and a portion of other dots included in said row of characters;

(f) moving the carriage across the printing medium in a second pass at the same faster, first, carriage speed while printing the other of each pair of horizontally close adjacent dots included in said vertical strokes of said characters comprising said row of characters and any remaining unprinted other dots included in said row of characters;

(g) advancing the printing medium to a position for the printing of a next row of characters only after said first and second passes; and, (h) if the printer is finished printing an indicated number of rows of characters to be printed, then exiting, otherwise returning to step (e).

* * * * *